US011008078B2

(12) United States Patent
Bardelli

(10) Patent No.: US 11,008,078 B2
(45) Date of Patent: May 18, 2021

(54) FLOATING AND MANOEUVRABLE HULL WASHING AND CLEANING PLANT FOR SHIPS

(71) Applicant: Guido Bardelli, Carpi (IT)

(72) Inventor: Guido Bardelli, Carpi (IT)

( * ) Notice: Subject to any disclaimer, the term of this patent is extended or adjusted under 35 U.S.C. 154(b) by 0 days.

(21) Appl. No.: 16/500,735

(22) PCT Filed: Apr. 3, 2018

(86) PCT No.: PCT/IT2018/050059

§ 371 (c)(1),
(2) Date: Oct. 3, 2019

(87) PCT Pub. No.: WO2018/185797

PCT Pub. Date: Oct. 11, 2018

(65) Prior Publication Data

US 2020/0102058 A1 Apr. 2, 2020

(30) Foreign Application Priority Data

Apr. 4, 2017 (IT) ..... 102017000036975

(51) Int. Cl.
*B63B 59/08* (2006.01)
*B63C 1/02* (2006.01)

(52) U.S. Cl.
CPC ..... *B63B 59/08* (2013.01); *B63C 1/02* (2013.01)

(58) Field of Classification Search
CPC ..... B63B 59/00; B63B 59/06; B63B 59/08; B63B 1/00; B63B 1/02
USPC ..... 114/222
See application file for complete search history.

(56) References Cited

U.S. PATENT DOCUMENTS 3,752,109 A * 8/1973 Seiple ..... B63B 59/08 114/222
5,988,093 A 11/1999 Ni

FOREIGN PATENT DOCUMENTS

| | | | |
|---|---|---|---|
| CN | 1190372 | A | 8/1998 |
| CN | 105658517 | A | 6/2016 |
| DE | 20 2008 010 540 | U1 | 11/2008 |
| WO | WO 97/02983 | | 1/1997 |
| WO | WO 2014/087207 | A1 | 6/2014 |

(Continued)

OTHER PUBLICATIONS

International Search Report in PCT/IT2018/050059 dated Jun. 18, 2018.

*Primary Examiner* — Lars A Olson
(74) *Attorney, Agent, or Firm* — McGinn I.P. Law Group, PLLC.

(57) ABSTRACT

A floating and maneuverable hull washing and cleaning plant for ships, includes cleaning and washing means submerged below the water level and operating against the hull, propulsion members for moving the plant in the engagement and washing against the hull in its length, members for controlling and changing the buoyancy displacement of the plant with control of the immersion level; a basin with side walls within which the cleaning and washing means are positioned, the cleaning and washing means being arranged in said basin and brought into contact with the hull during the cleaning with the control of the plant floating and of the position of the support members of the cleaning and washing means with respect to the basin itself; and guiding members for engaging and positioning the ship during the treatment.

20 Claims, 8 Drawing Sheets

(56) References Cited

FOREIGN PATENT DOCUMENTS

WO WO 2015/052634 A1 4/2015

* cited by examiner

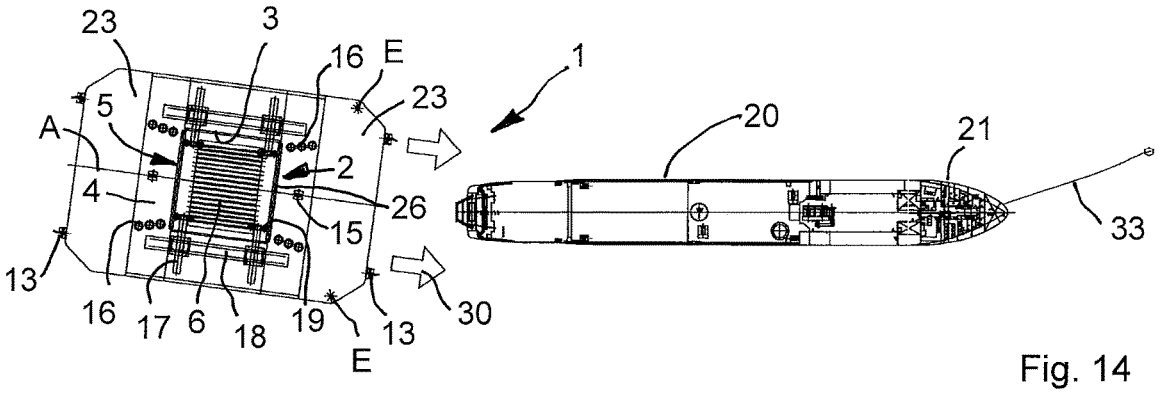
Fig. 14
Fig. 15
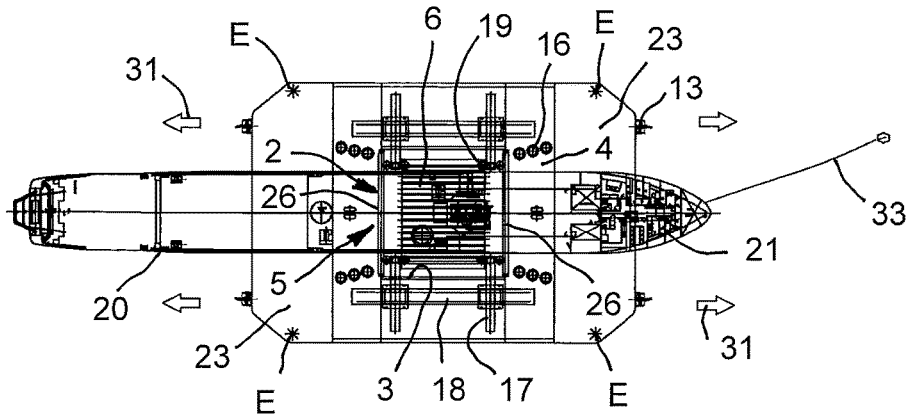
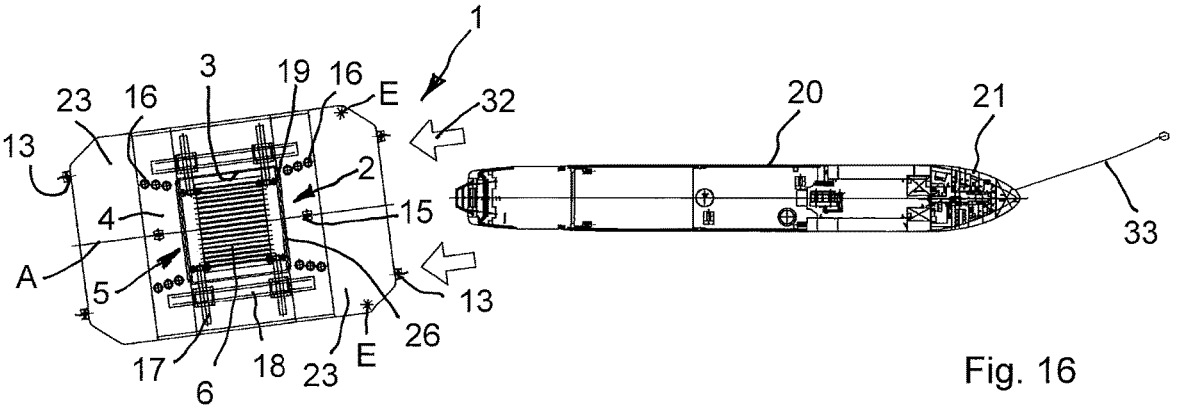
Fig. 16

FLOATING AND MANOEUVRABLE HULL WASHING AND CLEANING PLANT FOR SHIPS

FIELD OF APPLICATION

The present invention relates to a floating and maneuverable hull washing and cleaning plant for ships, that is to say a plant, located near the mooring ports of the ships, comprising means for intervention on the submerged hull of the ships to be treated, which are positioned to maneuver the plant in order to surround the hull of the ship to be treated and act in a quick, semi-automatic or automatic and economic way in performing the cleaning treatment to remove dirt, vegetation or "fouling" that grows spontaneously on the submerged part of the hull of a ship.

PRIOR ART

The state of the art comprises various types of hull cleaning plants for ships in which there are various forms of semi-floating or floating basin plant which drives the means for washing and cleaning the hull of the ship being treated, while the ship stays in the plant area.

In the art there are known constructive forms of hull washing and cleaning plants for ships wherein the washing water is collected immediately after operating on the hull for the removal of vegetation; water is collected in a filtration device and returned to the port purified from dirt, vegetation or "fouling".

In fact, from the prior document U.S. Pat. No. 3,541,988, a plant for the cleaning of a hull portion of a ship, while it floats, is known, which includes a cyclically operated flexible cleaning strip brush, and a support assembly for pushing the cleaning strip to follow the shape of the hull. There are means for towing the ship through the cleaning system so as to present the hull portions to the cleaning assembly while the hull moves beyond the flexible cleaning strip brush.

In this plant, the washing water is dispersed in the port even if the structure of the support assembly of the flexible cleaning strip brush has a light and easy to construct conformation. Current regulations, in some states and in consideration of the use of anti-vegetative paints on the ship framework, no longer allow the use of systems and plants for washing and cleaning the hulls of ships that do not collect and purify the washing water.

From document FR 2199311 a hull washing device for ships is known comprising: a semi-floating basin having a U-shape and adapted to be engaged transversely under the framework; the basin being designed to be moved along the longitudinal axis of the ship being guided by it, during its movement with respect to said framework; there are control means for moving said basin along the hull and there are cleaning means mounted on the basin and suitable for exerting a mechanical sliding action on the framework. The basin is used with the ship, generally large, anchored in a port, and the cleaning treatment of the hull takes place during the unloading and loading phases of the same.

Also, this system does not provide for the collection of the washing water and its purification and the means described and used cannot therefore respond to a compliant use of the current legislation in some states.

Moreover, from the document EP 1060983 a cleaning system consisting of water-jet nozzles, roller-shaped rotating brushes and other cleaning devices is known. The washing area is built into the internal space of a floating basin with opening and closing of the space. Some supports block the body of the boat in the washing area and the washing and cleaning means are slidable inside the floating basin to act on the whole surface of the framework. The compartment inside the floating basin is closed at both ends by two movable bulkheads to retain the washing water and perform its purification.

Although this plant already provides for the treatment and filtration of the washing water, it is not suitable to operate on vessels of various kinds, small or large, since the cleaning means are moved on separate carts inside the floating basin and the washing and cleaning operation, taking place with the floating vessel, involves a large amount of water to be purified. The cost of such a floating basin plant is therefore high if conceived for medium or large ships.

The state of the art also includes the document WO 9702983 wherein a floating basin is described, suitable for cleaning ship hulls, and a method of cleaning ship hulls, employing the floating basin that is ballasted and made independent by its own engine. The floating basin, comprising means for receiving a ship framework, is substantially U-shaped and can be, at least partially submerged, so that a base part, including the cleaning means, can be placed under the ship framework. The side cleaning means are present on at least one inner side of the ship framework, just as the receiving means can be adjusted according to the shape of the hull, to come into contact on one side of the ship framework. Means are provided for adjusting the position of the side cleaning means to allow them to substantially follow the contour of the sides of the ship framework. Means can also be provided to collect debris removed during the cleaning operation with the subsequent discharge at a remote site.

Moreover, the aforementioned plants of the prior art do not allow the construction of a plant that has a practical use for cleaning the hulls of both small and medium-sized vessels or large vessels from fouling and marine vegetation in a quick, cheap and effective way, retaining and purifying the discharge of effluents, where and when required, with the washing water and dirt in the port where the hull washing and cleaning plant for ship hulls is located and operates.

In the art there are also known systems for cleaning the hull of ships wherein one or more devices adhering to the immersed part of the hull are used and which cover a fairly small surface thereof; they are moved automatically in the various areas of the hull in succession so as to perform the cleaning on a large part of the hull of the ship. The device comprises adhesion means to the hull, generally magnetic, and mechanical cleaning means of the part of the hull included in the compartment covered by the device. The device is connected to the necessary pipes for washing and removing water mixed with the dirt thus detached that is conveyed and collected for subsequent filtration and controlled disposal.

Moreover, the operation of such devices is slow, in relation to the needs of the stopping times of the ship in the port, and it cannot be realized in the roadstead, since it takes several hours to properly clean a hull of a large transport ship.

Therefore, the aforementioned hull cleaning and washing plants for ships are insufficient and do not allow to provide the necessary continuous cleaning from dirt, marine vegetation or "fouling" that is continuously formed on the hull of a ship: more while stopping in the ports of docking and in a minor way, due to the continuous slipping into the water, during travel. In fact, the ships that mostly require the cleaning and washing of the hulls are also subject to an intense use for the transport of goods, for example containercarriers, ships for liquid product transport, such as oil tankers, or even passenger ships, so they do not have adequately long stopping times, precisely needed for the careful cleaning of the hull. Finally, these plants must comply with local anti-pollution regulations, which can allow the discharge of wastewater, only if removed from hulls not covered by specific and poisonous anti-vegetative paints.

This state of the art is subject to considerable improvements with regard to the possibility of creating a floating and maneuverable hull washing and cleaning plant for ships which overcomes the aforementioned drawbacks and makes it possible to use it in washing and cleaning ship hulls, achieving a remarkable reduction of the treatment times, particularly when the ship is at anchor in the roadstead, in a port or in a closed water surface, and having to wait for technical times to enter the port or its turn to cross a canal, for example Suez or Panama canal and requires cleaning in the waiting time also realizing the possible collection and controlled disposal of the dirt removed from the hull of ships or vessels.

Therefore, the technical problem underlying the present invention is to realize a hull washing and cleaning plant for ships, but which achieves a concrete ability to improve the time required to perform the washing and cleaning of the hull of a ship and which is affordable in terms of costs of construction and operation also for large cargo or passenger ships.

A further but not last object of the present invention is to allow the realization of a hull cleaning and washing plant for ships that operates concurrently with the technical berthing times of the ship before entering the port or crossing a canal.

As an addition to the previous purpose it is necessary to be able to perform the washing operation without permanently having to engage a port dock or, in any case, port spaces.

Still further, another object addressed in the present invention is to provide a constitution of means of a hull cleaning and washing plant for ships that can be made in various dimensional conformations both for use with hulls of small ships or vessels, with hulls of ships of medium dimensions and which can be also made for the cleaning and washing of hulls of large ships, which are notoriously those whose owners are the most sensitive to in terms of framework cleaning to contain the costs of fuel and of the costs of unproductive stops of ships, creating a more continuous use in navigation and moreover, as an advantageous consequence, also limiting the pollution produced by fuel consumption and, consequently, diminishing gas emissions in the atmosphere.

In addition, a corollary to the above purposes is the realization of hull cleaning and washing plants for ships operating for all types of hulls, including hulls that have submerged framework appendages.

Finally, to complete the faced problems, the floating and maneuverable plants can be shaped to be easily transported or towed to other ports or service areas so as to extend also the coverage area in terms of washing service offer according to changed conditions of merchant and/or passenger traffic.

SUMMARY OF THE INVENTION

This problem is solved, according to the present invention, by a floating and maneuverable hull washing and cleaning plant for ships, including cleaning and washing means submerged below the water level and operating against the hull; propulsion members for moving the plant in the engagement and washing against the hull in its length; members for controlling and changing the buoyancy displacement of the plant with control of the immersion level; the structure of the plant also includes a basin with side walls within which the cleaning and washing means are positioned; characterized in that it has the cleaning and washing means arranged in said basin e brought into contact with the hull during the cleaning with the control of the plant floating and of the position of the support members of the cleaning and washing means with respect to the basin itself; guiding members for engaging and positioning the ship during the treatment; the cleaning and washing means are moved along the hull being treated with the displacement of the basin; the cleaning and washing means operate simultaneously on the section of the hull covered by the length of the side walls; the basin has a more extended floor of the dock at the bow and at the stern of the side walls length to house the control members of the displacement of the floating plant itself.

Furthermore, in an improved form: the cleaning and washing means are associated with water suction members, placed in the side walls and in the floor of the dock between the walls, to collect the wastewater coming from the washing and the dirt removed from the hull.

Even more, in a specific variant: the suction members are connected to a filtration apparatus before the evacuation of the purified water; the filtered material is periodically evacuated from the plant in an ecologically controlled manner.

In addition, in a further variant: at the ends of the side walls, flexible and inflatable bulkheads are made in the upper edge, to adhere to the hull during the treatment and, moreover, the flexible and inflatable bulkheads have the upper inflatable edge equipped with rollers for sliding the flexible and inflatable bulkhead when in contact with the hull of the ship being treated.

Even more, in a further application: the cleaning and washing means consist of rotating brushes having a horizontal axis which is longitudinal to the axis of the floating plant.

Furthermore, in a further variant: the cleaning and washing means consist of multiple belts with pressurized water jets oriented towards the surface of the hull being treated.

Even more, in a specific variant: the propulsion, pumping and moving members of the parts and the service member of the floating plant are driven by electric transmission powered by hybrid power, electric power coming from the batteries aboard the floating plant and by a backup and/or battery charging electric generator.

Moreover, in an improved form: the positioning members comprise lateral pushers, protruding towards the centre of the basin with arms provided with rollers in contact with the bulwarks of the engaged ship during the treatment.

Even more, in a further constructive form: the guiding means for engaging the ship comprise lateral supports at the level of water for guiding the framework, which are aligned so as to converge with the longitudinal axis of the plant.

Finally, in a specific and preferred constructive variant: the operations for displacing the plant and its constant control; engaging and disengaging the hull of the ship with approach and alignment maneuver with continuous control of the centering of the hull; cleaning treatment operation of the hull with continuous command and control of the cleaning and washing means including the adjustment of the position of the means themselves in the treatment basin between the side walls and on the floor of the dock; storing the cleaning and washing service data of the hull in the control of the plant movements and the plant internal parts;

are performed by a command and control process of the floating and maneuverable plant, for each hull of a ship treated to form a database so as to allow, in carrying out repeated cleaning and washing services over time, the semi-automatically or automatically treatment operation.

The features and advantages of the present invention, in the realization of a floating and maneuverable hull washing and cleaning plant for ships, are mentioned in the following description of some schematic application examples, given by way of non-limiting example, with reference to the eight attached drawing tables.

BRIEF DESCRIPTION OF THE DRAWINGS

Moreover.

FIG. 14 shows a schematic plan view of the floating plant of previous Figures, during the engagement for the treatment of a ship, suitably anchored in the roadstead or other shallow seabed of calm sea area;

FIG. 15 shows a schematic plan view of the plant according to the invention while carrying out the washing and cleaning treatment of a ship hull after the engagement of FIG. 14: the relative motion of washing progression can take place in both directions, while the ship is anchored;

FIG. 16 is a schematic plan view of the floating plant of FIG. 15, at the end of the treatment of the ship hull: the ship remains anchored and the floating plant is disengaged from the ship;

DETAILED DESCRIPTION OF A PREFERRED EMBODIMENT

Figure 1:
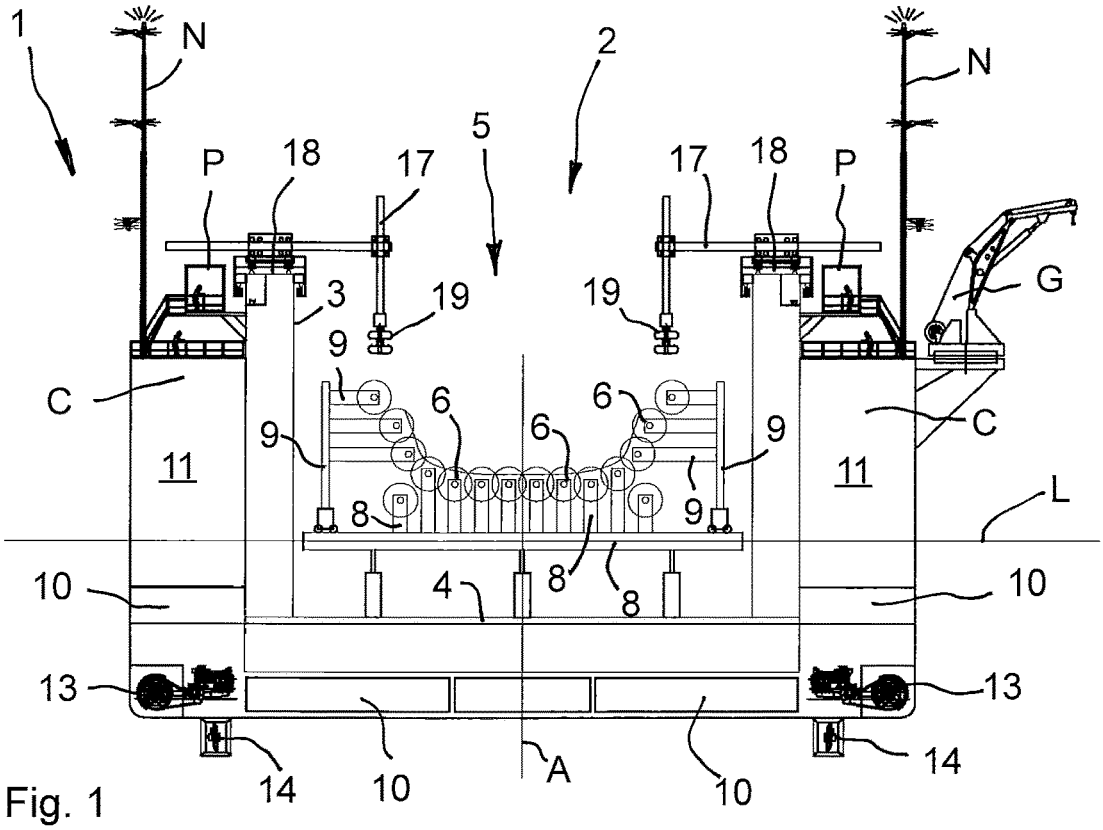
FIG. 1 shows a schematic cross-sectional view of a floating hull washing and cleaning plant for ships, according to the invention, in a surfacing position of the washing and cleaning means shown here with rotating brushes with an axis longitudinal to the hull of the ship.
Figure 2:
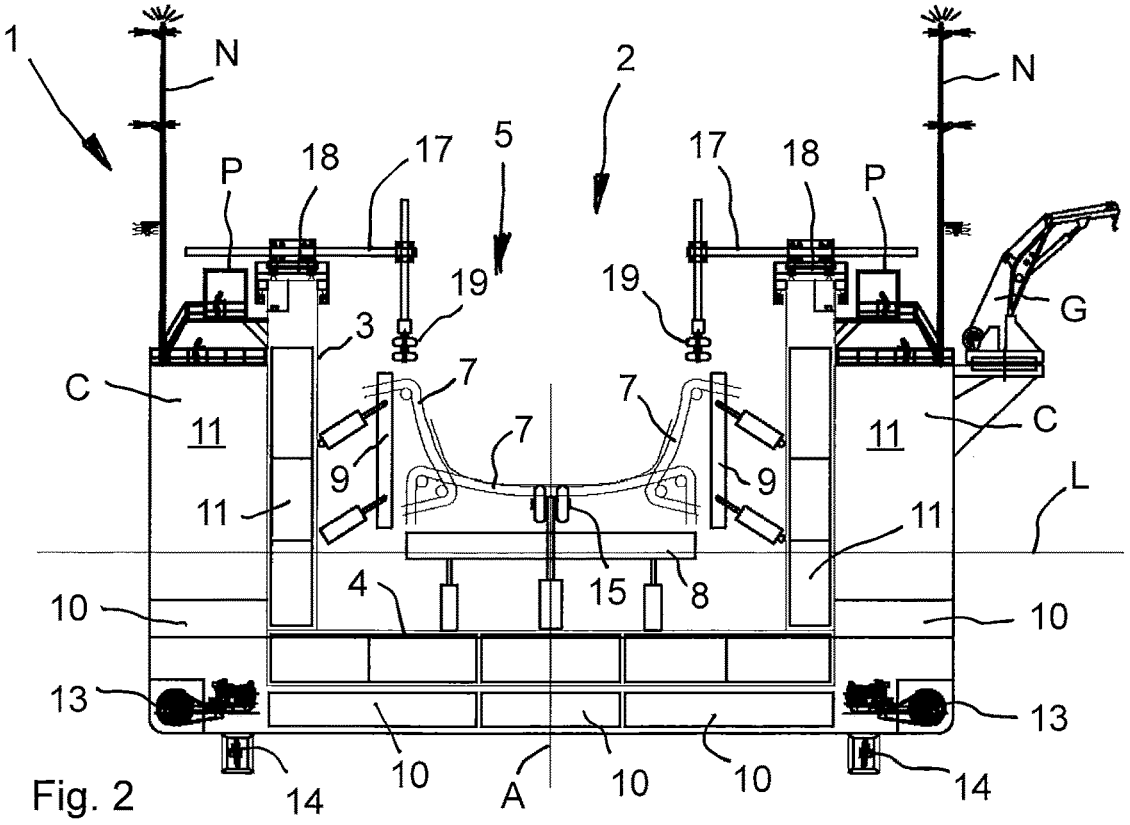
FIG. 2 shows a schematic cross-sectional view of the floating hull washing and cleaning plant for ships similar to FIG. 1, wherein the means for washing and cleaning the ship hulls realized here with nozzle belts which spray high pressure water jets on the hull during the cleaning treatment are shown.

FIGS. 1 to 4 show the floating plant 1, comprising a basin 2, formed between side walls 3 and a floor 4 of the dock for joining the walls within which the cleaning and washing means 5 are positioned; they consist of rotating brushes 6 having an axis longitudinal to the hull of the ship or even multiple belts 7 with nozzles, which spray pressurized water on the hull; both the rotating brushes 6 and the multiple belts 7 are supported, with respect to the walls and the floor of the dock, with vertical 8 and/or horizontal 9 movable supporting members; in the walls and in the floor of the dock there are floating chambers 10, for the computerized control of the plant displacement, and technical compartments 11 for housing the moving member of the washing and cleaning means, both for the movement, such as hydraulic systems for operating the movable supports for positioning the brushes 6 and multiple belts 7, and for the operation, such as washing and filtering water thrust pumps, or for the rotating operation of the rotating brushes 6; moreover, in the thickness of the floor of the dock there are longitudinal propulsion members 13 and transverse propulsion members 14 housed therein to carrying out the maneuvering of the floating plant 1 when engaged with the hull of a ship and the movement along said hull, to carry out the forward movement during the cleaning and washing treatment thereof.

The engagement of the hull of a ship takes place by means of the members of the wheel mechanical spacer 15 of the hull axis with the longitudinal axis A of the plant 1; the extension of these members is controlled by the floor 4 of the dock, to detect the mutual position between the hull and the plant 1 and continuously control both the displacement of the plant and the positioning of the cleaning and washing means 5, also during the phase of hull treatment; the plant is engaged with the hull by centering it with the lateral supports 16 at the water level L which guide the framework, advantageously aligned so as to converge with the longitudinal axis A, and consisting of large and robust idle rollers having a vertical axis and a rubber coating; after the engagement, the centering of the ship with the plant is maintained with lateral pushers 17, protruding towards the centre of the basin 2 from the top 18 of the side walls 3: the pusher arms end with rollers 19 designed to come into contact with the bulwarks 20 of the engaged ship 21 during the treatment; the operators in charge check from the dashboards P the operations of engagement and treatment of the plant 1 on the hull 22 of the ship 21 both in case of semi-automatically operation and if the engagement direction, the plant displacement and the treatment phases are automatically controlled by the on-board computer which controls the floating, the maneuver and the treatment operation of the floating and maneuverable plant according to the invention.

The structure of the floating plant of the invention is characterized by an extension 23 at the bow and stern, although the plant 1 is completely symmetrical in length and can operate indifferently in the two opposite directions; these extensions of the floor 4 of the dock serve to contain a distribution of floating chambers 10, so as to achieve the control of the thrust for the displacement of the plant in an easier and more effective way; moreover, these extensions of the floor 4 of the dock position the longitudinal 13 and transversal 14 propulsion members, to achieve a greater efficiency in steering the plant during maneuvers.

On the ends of the extensions 23 of the floor 4 of the dock there are emerging columns E, also in the immersion condition of the floor of the dock, to highlight with end-outline marker lamps the space occupied by the plant in the sea area during the transfer and engagement maneuvers and also during the washing treatment of the engaged ship.

The side walls 3 are completed by corresponding quarter-deck C both to the right and the left of the basin 2; on the quarter-deck C there are also accessory members such as a service crane G and the antennas N for the light warning signal of the plant as a vessel and the signal transmission over the air. Moreover, near the bow and stern ends of the side walls 3 there are flexible bulkheads 25 with inflatable edge 26, which regulate the floatation or lowering level so as to allow the engagement and/or disengagement of a hull 22.

Figure 6:
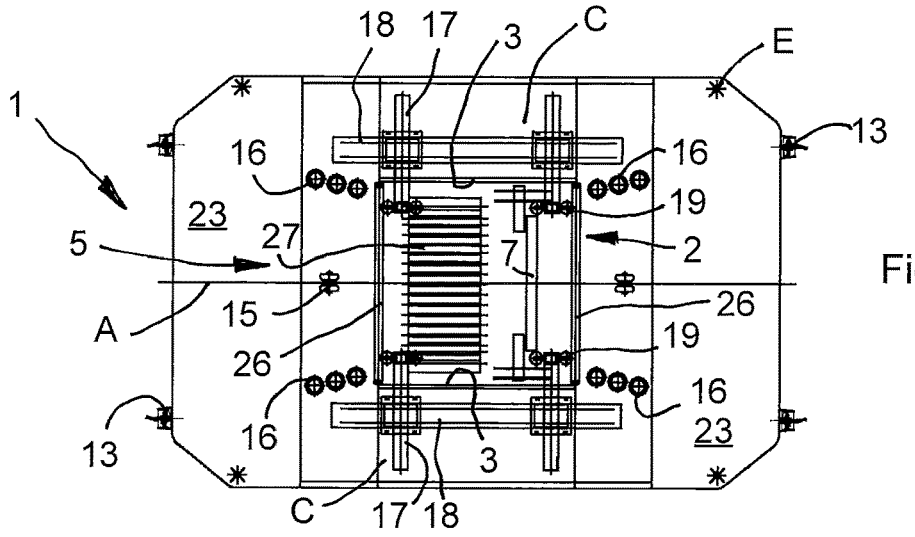
FIG. 6 shows a schematic plan view of the plant according to the invention, wherein the mixed washing and cleaning means are outlined, i.e. means consisting, on the one hand, of short rotating brushes, of FIG. 1, having a longitudinal axis and, for the remaining length of the plant, consisting of belts with nozzles spraying pressurized water of FIG. 2.
Figure 7:
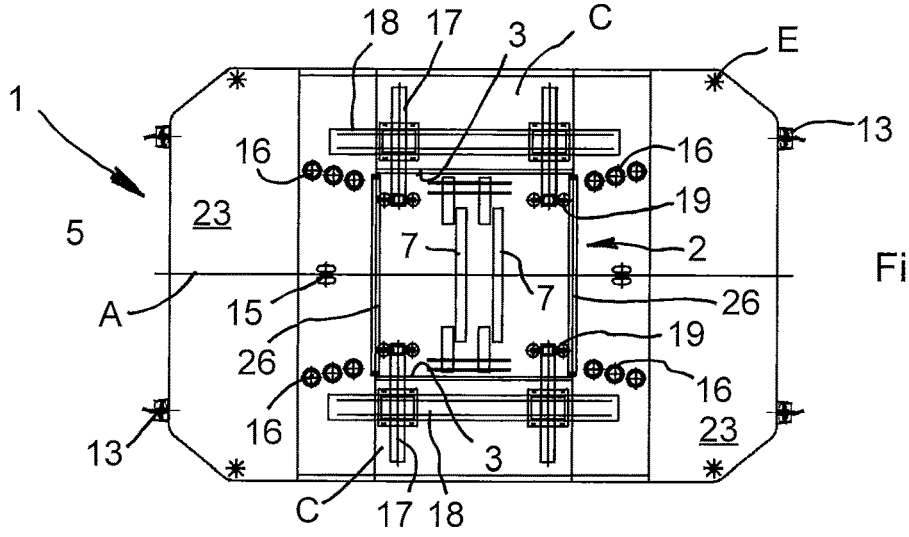
FIG. 7 shows a schematic plan view of the plant according to the invention, wherein washing and cleaning means consisting only of belts with nozzles spraying pressurized water of FIG. 2 are outlined.
Figure 8:
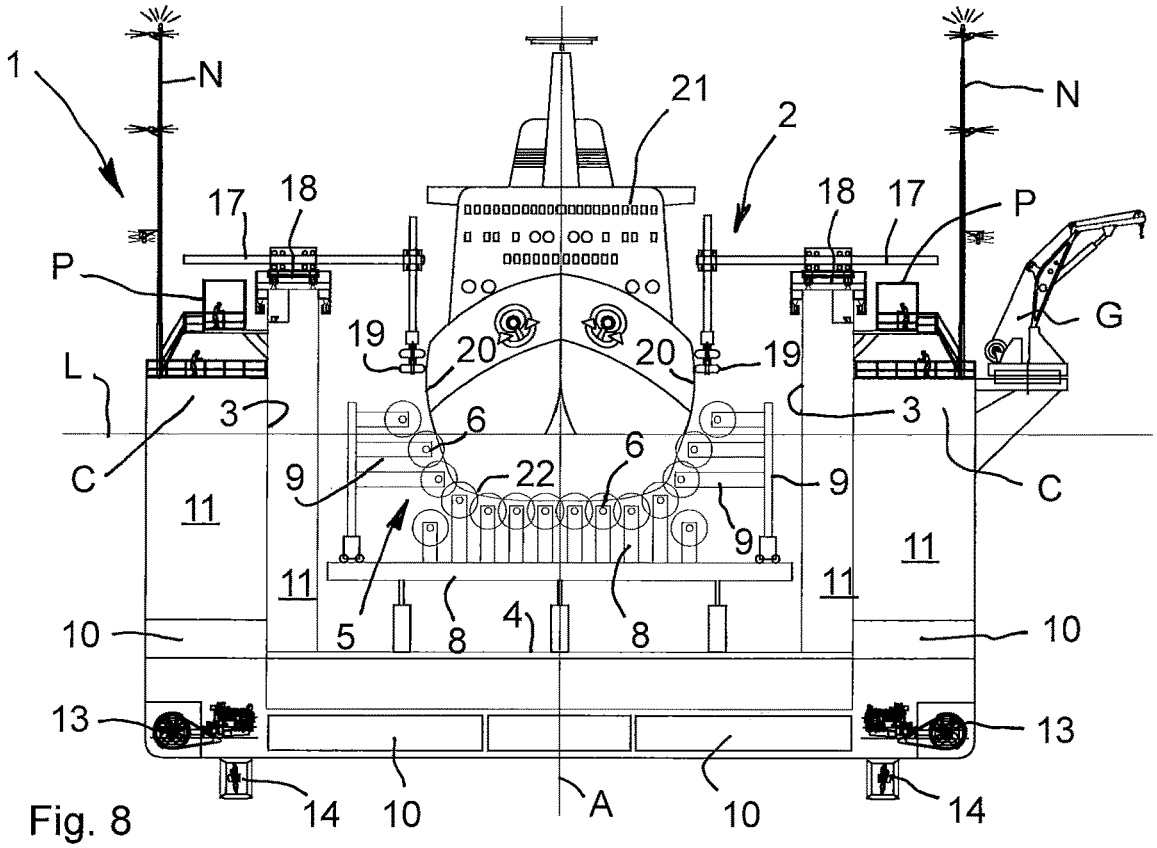
FIG. 8 shows a schematic cross-sectional view of the here submerged plant of FIG. 1, during the washing and cleaning phase of the hull of the generic ship illustrated.
Figure 9:
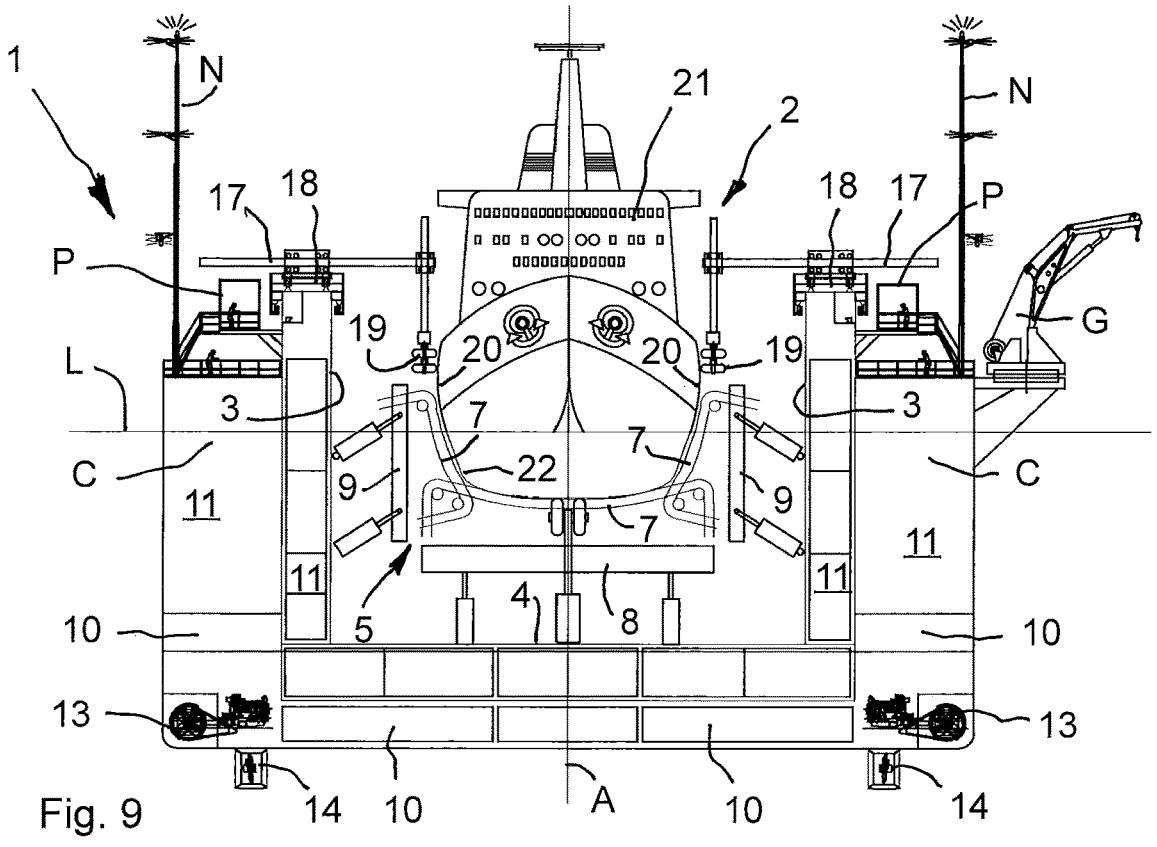
FIG. 9 shows a schematic cross-sectional view of the here submerged plant of FIG. 2, during the washing and cleaning phase of the hull of the generic ship illustrated.

Moreover, FIGS. 5 to 9 show: the position of the cleaning and washing means 5 in the basin 2 and their positioning in the treatment phase; as well as the position of the guiding means of the plant during the engagement of the hull 22 both in plan, i.e. the distribution on the floor 4 of the dock, and in approaching and contacting during the cleaning and washing treatment. FIG. 6 shows the mixed cleaning means 5 i.e. consisting of short rotating brushes 27, with horizontal axis and longitudinal direction to the hull, and a series of multiple belts 7 on the hull, operating thereon, in the same basin 2 of the floating plant of the Figure.

Figure 3:
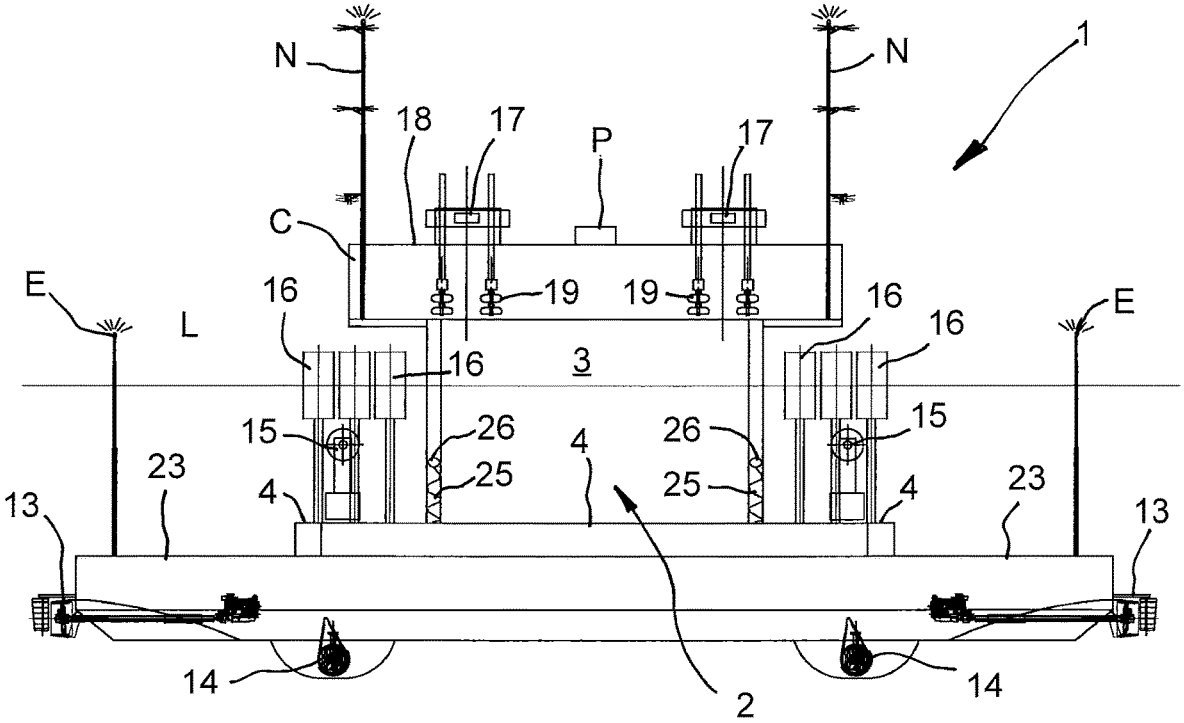
FIG. 3 shows a schematic view in longitudinal section of the plant of FIG. 1 or 2, shown here without means for washing and cleaning the hull of the ship which is engaged for the treatment, but in which the means for centering the hull and containing the framework are shown in the engagement and treatment phases.
Figure 4:
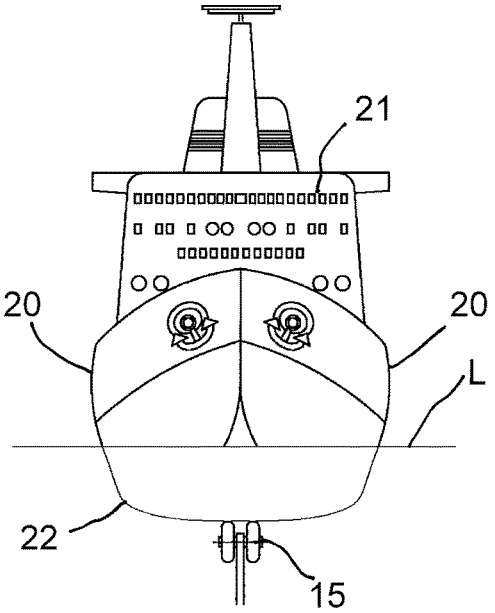
FIG. 4 shows a schematic front view of a generic ship in the engagement with the floating plant of previous Figures, wherein it is illustrated the ship which engages with the centering reference of the hull for the correct engagement and support on the mechanical spacer between the plant for the cleaning treatment and the ship itself.
Figure 5:
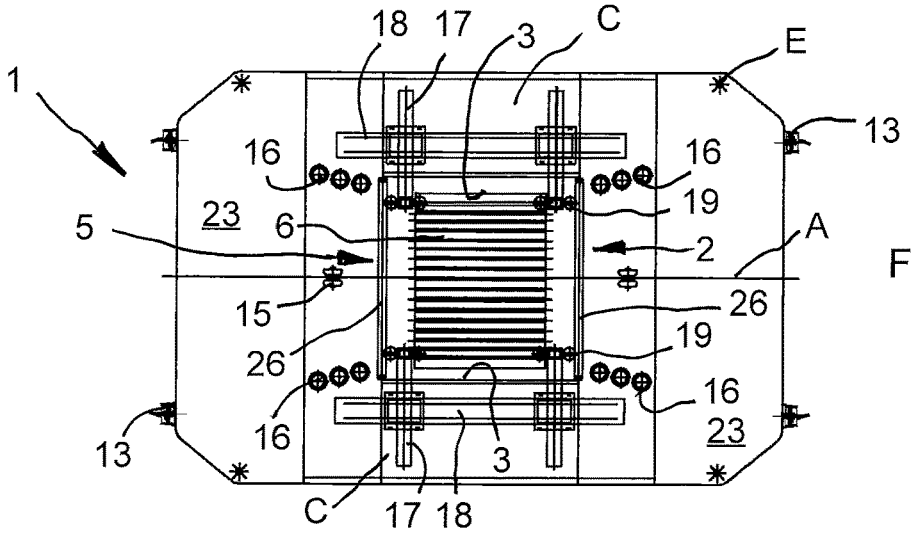
FIG. 5 shows a schematic plan view of the plant according to the invention, wherein washing and cleaning means consisting only of the rotating brushes having an axis longitudinal to the hull of FIG. 1 are outlined.
Figure 10:
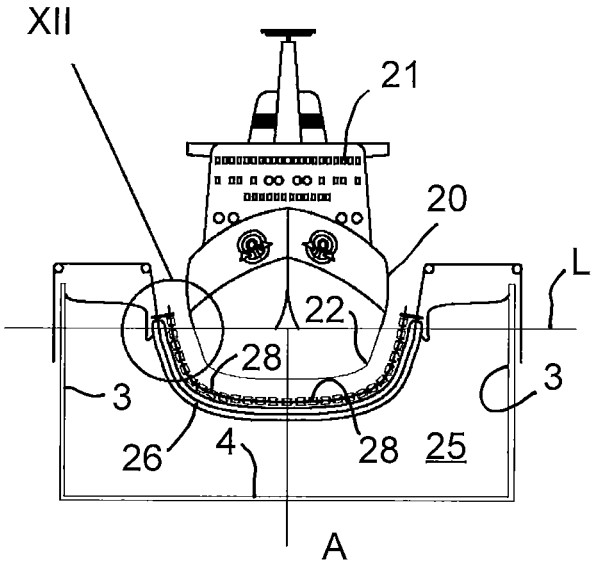
FIG. 10 shows a partial schematic front view of the floating plant of the previous Figures wherein, during the treatment of a specific section of the ship hull, flexible and inflatable bulkheads are provided, which are represented here in the lowered state and ready to be raised against the hull to be treated of the floating ship.
Figure 12:
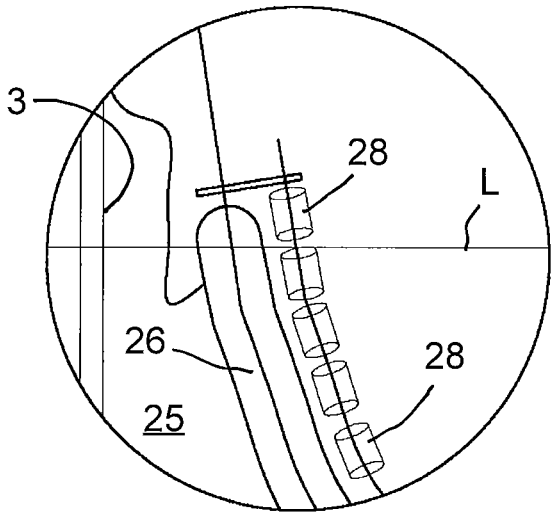
FIG. 12 shows an enlarged schematic view of the detail XII of the previous FIGS. 10 and 11 to outline the constitution of the sliding rollers of the upper edge of the flexible and inflatable bulkhead against the surface of the ship hull being treated.
Figure 11:
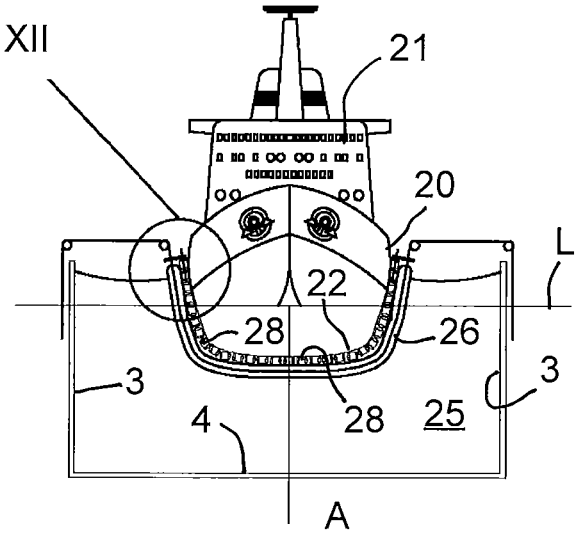
FIG. 11 represents a partial schematic front view of the floating plant according to the invention of the previous Figure, wherein the flexible and inflatable bulkhead is shown here raised against the hull to be treated; in this position, the upper edge of the inflatable and flexible bulkhead is provided with sliding rollers for the use of these bulkheads which operate continuously on the hull to be treated in order to allow the slow sliding.

FIGS. 10 to 12 outline the sliding rollers 28 of the flexible bulkhead 25, protruding towards the surface of the hull 22 to be treated which are slidable thereon as the implant 1 moves forward along the hull to treat it. Obviously, the seal is not hermetic, but most of the cloudy water with the residues of removed dirt and "fouling" remains within the two flexible bulkheads at the ends of the basin 2 and it is contained between the side walls 3. The bulkheads of FIG. 3 are similar to these shown, but if they are made without the sliding rollers 28, they need the detachment of the inflatable edge, even at a short distance from the hull 22, to allow the floating plant 1 to move forward during the treatment that, therefore, can be performed at sections of hull.

Figure 13:
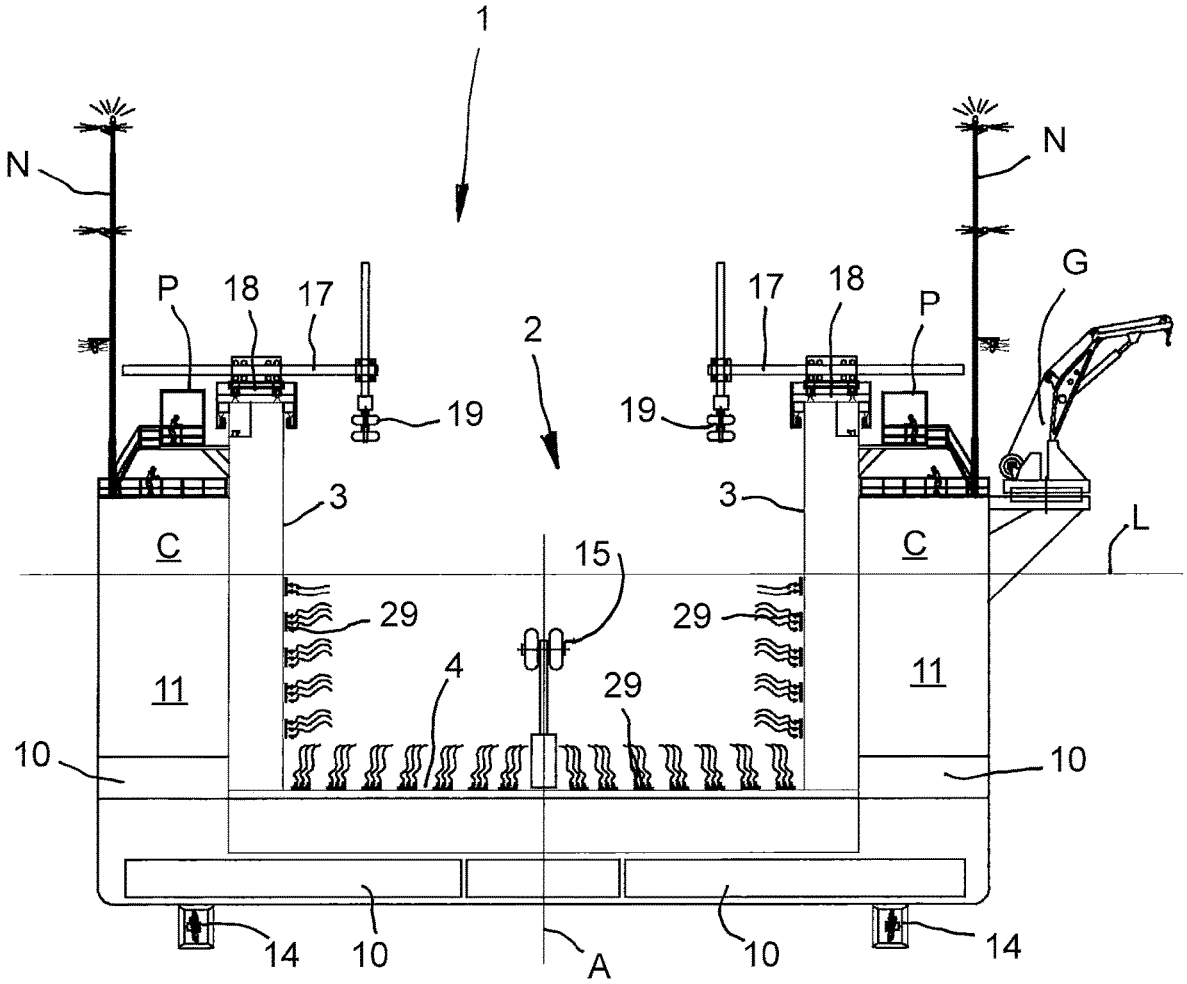
FIG. 13 shows a cross-sectional schematic view of the floating plant of previous Figures, wherein the suction mouths of the water used and surrounding the hull surface being washed are outlined, which operate during the cleaning treatment for the subsequent filtration and separation of the sludge and removed vegetative material, intended for the subsequent controlled disposal.

Moreover, FIG. 13 outlines the distribution in the floor 4 of the dock, only in the area between the side walls and in the inner part of the side walls 3 of suction mouths 29 of the water surrounding the cleaning and washing means 5.

The floating plant 1 is shown in FIGS. 14 to 16 during the phases of engagement of a generic ship 21, cleaning and washing treatment of the hull 22 and disengagement from the clean ship. The reference numbers are the same as those of the previous figures, the approaching direction 30, which may not be perfectly aligned with the ship framework, and the indication of the feeding motion 31 in the cleaning and washing treatment of the hull, possible in both directions both to and from the bow of the ship 21 being outlined. Once the treatment has been completed, the floating plant 1 is disengaged from the ship following the exit direction 32, which may also be not perfectly aligned with the ship itself. During these phases the ship remains advantageously at the anchor 33, in order to facilitate the engagement phase of the floating plant 1 thereto.

Figure 17:
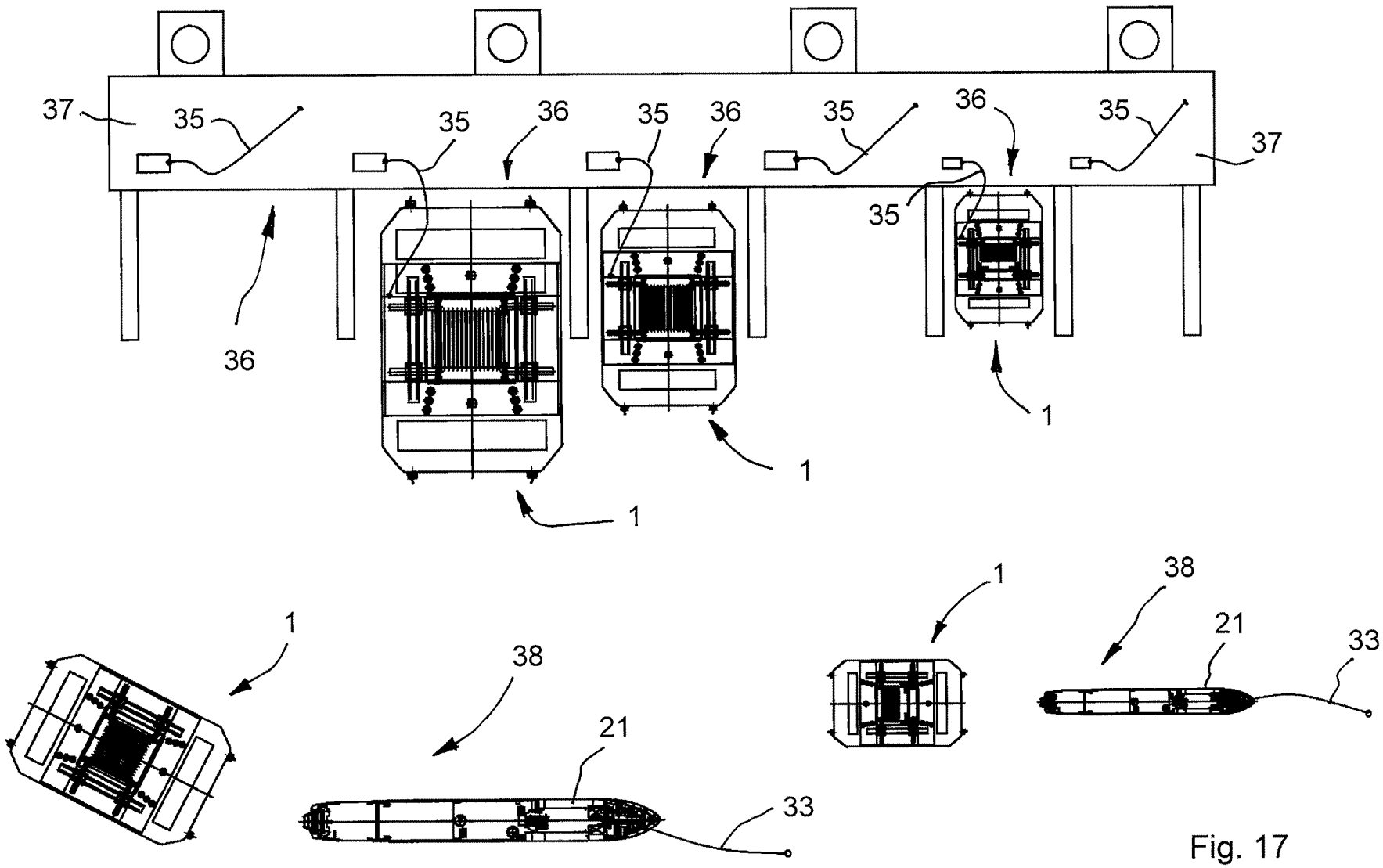
FIG. 17 shows a schematic plan view of a docking point of a series of floating hull washing and cleaning plant for ships, having here different dimensions to operate on ships with different width framework; moreover, the floating plant being in the electric version and wherein the power developed by a combustion diesel engine is used only as assistance and/or battery charging aboard the floating plant; moreover, the charge is normally provided by the single electric supply for the plant which is in the dock of the docking point.

In a further constructive form, as shown in FIG. 17, a floating plant 1 is realized by electric propulsion, i.e. by electric means such as electric engines and related batteries having an adequate capacity, not shown, for the propulsion in the propulsion members 13 and 14 and, moreover, also in the movement of the cleaning and washing means 5 as well as in the displacement and control operations regardless of the way in which they are performed. On the floating plant a thermal energy electric generator is installed, advantageously with a diesel engine, for the assistance in case of depletion of electric power reserves stored in the batteries.

FIG. 17 shows some floating plants 1 of different acceptable framework dimensions. They are all of the electric drive and hybrid, i.e. mainly electric, supply type, as said, by means of battery charging with the electrical connection 35 which is in each docking station 36 in the pier 37. The pier being positioned in a roadstead or other suitable area 38, close to the port of destination of the ship 21, for carrying out the cleaning and washing treatment of the hull. The electric power needed to recharge the batteries is provided by both traditional and photovoltaic or wind energy ground-mounted production plants. The most advantageous production is achieved by receiving energy from an offshore renewable energy production plant, which, as is known, can be realized as wind or photovoltaic energy plants.

The operation of the floating and maneuverable hull washing and cleaning plant for ships described above takes place as described herein.

The floating plant is normally maintained in a complete floating position, i.e. with the floor 4 of the dock and the extensions 23 of the floor of the doc above the water level L. This allows the correct maneuver of the plant with the operator who can visually command the plant during transfer from the docking pier, such as the pier 37, towards the sea area where the engagement and the treatment operation of the relevant ship 21 will take place. Obviously, navigation in this complete floating condition is facilitated due to the lower resistance that the plant constitution itself offers to the water flow. Moreover, in this position, it is possible to perform all the assistance operations and also the scheduled or occasional or extraordinary maintenance which can be performed at the aforementioned docking pier.

The treating operation of a ship 21 hull 22 takes place by the engagement of the plant 1 with the ship itself (FIG. 14). The plant is displaced at the engagement height of the hull; obviously knowing and adjusting the floating level with respect to the draught of the relevant hull. In the position of FIG. 14 the ship 21 is already at the anchor 33 and the plant in the engagement motion in the direction 30 is maintained at the above-mentioned engagement height. The operator during the engagement makes use of the detection, by means of GPS coordinates, of the plant but also of the relevant ship and visually controls the approach with the lights E of the extension of the floor 4 of the dock, before the physical contact of the ship 21 stern against the lateral supports 16 for guiding the framework 20 during the engagement. The ship in the engagement operations does not perform any activity and the operator controls and maneuvers in all directions, obviously with weighted maneuvers, the alignment of the ship hull axis with the plant axis A, verifying first the front and then the rear contact and correct alignment between said axes with the mechanical centering members 15. Once the engagement alignment has been made, from the top of the walls 18 the lateral pushers 17 having the rollers 19 in contact with the external walls of the framework 20 are positioned, continuously recording the position of the rollers 19 against the ship bulwarks 20, with a mechanical, advantageously hydraulic, servo-actuation. Once the engagement has been completed, the mechanical centering members 15 adjust the displacement of the plant for the correct position of the cleaning and washing means 5 against the hull 22; therefore, the treatment can be realized as follows.

The cleaning and washing treatment of the hull surface takes place through the combined and simultaneous action of the cleaning and washing means 5 on the hull itself. The adjustment of the height where they are positioned is carried out with the detection of the position of the mechanical centering members 15 which refer to the real position of the centre of the hull, i.e. the position of maximum draught, to the on-board computer of the plant that adjust the position of said means whether if they have rotating brushes 6, with horizontal and longitudinal axis, or multiple belts 7 with pressurized water jets.

The treatment operation, FIG. 15, can be performed in a continuous or discontinuous manner according to the need to contain the dispersion of the cloudy water and the wastewater obtained from the treatment. Without particular needs for this containment, the treatment can be performed continuously without retaining, sucking and, therefore, treating the said wastewater for disposal. Moreover, in the presence of strict rules for the containment of said wastewater and dirt or "fouling" removed from the hull, flexible bulkheads 25 with inflatable edge 26 can be used which, just after the inflation, adheres to the surface of the hull treated, preventing the exchange of cloudy water with the external cleaner one. In this condition it is advisable to suck the cloudy water through the mouths 29 in the plant so as to filter the water; the treatment operation is then performed in a discontinuous manner, i.e. it is cleaned a section of the hull for each placement of the plant 1 under the hull 22; in fact, it is convenient to remove the flexible bulkheads 25, with the inflatable edge 26, from the hull to perform the forward movement of the plant 1, thus performing the treatment of the next section of hull; this procedure maximize the collection of wastewater and dirt.

By using the flexible bulkheads 25 with the inflatable edge 26 and the rollers 28, the treatment operation can be carried out continuously along the hull without separate the rollers 28 from the surface of the hull itself. As mentioned above, the rollers 28 seal cannot be hermetic against the hull, but the high suction and treatment capacity of the dirty water determines a very low acceptable pollution residue which make it possible to perform the continuous procedure even with the most severe anti-pollution standards of certain ports or berthing areas of ships at anchor.

The operating mode of the rotating brushes 6 and 27 having the horizontal axis longitudinal to the hull is known in the art and does not require further explanation here. Moreover, even multiple belts 7 with pressurized water jets are known in the art, so no further explanation is provided. Moreover, their use in the basin 2, with the control of the displacement of the plant 1 and the pressure of the cleaning and washing means 5 against the hull, allows the adjustment of the maximum efficiency obtainable of the two cleaning means also in the presence of hulls 22 of very different transversal width and/or draught, allowing to limit the number of different dimensioning of the plant 1 as each of them can operate with very different hull dimensions.

Once the treatment has been completed, the plant 1 moves to the next step to be disengaged, FIG. 16, with actions and movements on the displacement opposite to the engagement phase described above.

Moreover, in the operation of the electric-driven hybrid constructive form of FIG. 17, the most interesting combination is between a production plant of electrical energy from renewable source, whether offshore or onshore, as it makes the floating and maneuverable cleaning and washing hulls for ships independent and can also be positioned far from the coast, so as not to clutter the port areas, obtaining a production and use of the power on site.

The advantages in the application of the constructive forms of floating hull cleaning and washing plant for ships described above can be summarized with the maximum practicality and versatility in performing the cleaning and washing service of ship hulls. In fact, floating and maneuverable plant of this type can be easily transported or towed to other suitable ports or suitable treatment areas, in order to effectively extend the catchment area or the coverage area in terms of service offer. In addition, with the floating and maneuverable cleaning washing plant it is possible to perform a preventive washing of the ship entering a port area or, if the marine weather conditions allow for that, to perform the washing treatment in the roadstead or close to the shore, or also on the transit passageways of the ships.

Another advantage is that it is possible to clean and wash ships entering some ports of nations that require strict controls for berthing and transit ships, so as to avoid contamination and damage to the marine ecosystem, i.e. to preserve it from non-autochthonous species transported through the "bio-fouling" attached to the framework.

Obviously, a person skilled in the art, in order to satisfy specific and contingent requirements, may make numerous modifications to a floating and maneuverable hull washing and cleaning plant for ships as previously described, all however contained within the scope of protection of the present invention as defined by the following claims. Thus, in claiming specific parts, the propulsion members 13 and 14 can be made only in the central position of the floating basin and not in the extensions 23 of the floor 4 of the dock. Even more, the positioning members of the framework being equidistant from the side walls 3 can be made with anthropomorphic mechanical means which position the rollers 19, designed to rotate against the bulwarks 20 of the ship 21, between the side walls to engage the ship bulwarks both horizontally between the side walls 3 and vertically to correctly position the said rollers 19 on the bulwarks 20 of the ship 21.

The invention claimed is:

1. A floating and maneuverable hull washing and cleaning plant for ships, the floating and maneuverable hull washing and cleaning plant including:

cleaning and washing means submerged below a level of water and operating against a hull;

propulsion members for moving the plant in engagement and washing against the hull in its length;

control members for controlling and changing a buoyancy displacement of the plant with control of an immersion level;

a basin with side walls within which the cleaning and washing means is positioned, the cleaning and washing means being arranged in the basin and brought into contact with the hull during a cleaning with a control of the plant floating and of a position of support members of the cleaning and washing means with respect to the basin itself; and guiding members for engaging and positioning the ship during a treatment, wherein the cleaning and washing means is moved along the hull being treated with the displacement of the basin, wherein the cleaning and washing means operates simultaneously on a section of the hull covered by a length of the side walls, and wherein the basin has a more extended floor of a dock at a bow and at a stern of the length of the side walls to house the control members of the displacement of the floating plant itself.

2. The floating plant according to claim 1, wherein the cleaning and washing means is associated with water suction members, placed in the side walls and on the floor of the dock between the side walls, to collect wastewater coming from washing and dirt removed from the hull.

3. The floating plant according to claim 2, wherein the water suction members are connected to a filtration apparatus before an evacuation of a purified water, a filtered material being periodically evacuated from the plant in an ecologically controlled manner.

4. The floating plant according to claim 1, wherein, at ends of the side walls, flexible and inflatable bulkheads are made in an upper edge to adhere to the hull during the treatment.

5. The floating plant according to claim 4, wherein the flexible and inflatable bulkheads include an inflatable upper edge equipped with rollers for sliding the flexible and inflatable bulkhead when placed in contact with the hull of the treated ship.

6. The floating plant according to claim 1, wherein the propulsion members for the maneuver of the floating plant are positioned on most extended parts of the floor of the dock at the bow and at the stern.

7. The floating plant according to claim 1, wherein the cleaning and washing means consists of rotating brushes having a horizontal axis which is longitudinal to an axis of the floating plant.

8. The floating plant according to claim 1, wherein the cleaning and washing means consists of multiple belts with pressurized water jets oriented towards a surface of the hull being treated.

9. The floating plant according to claim 1, wherein the propulsion members, pumping and moving members of parts and a service member of the floating plant are driven by an electric transmission powered by a hybrid power, an electric power of batteries aboard the floating plant and by a backup and/or a battery charging electric generator.

10. The floating plant according to claim 9, wherein a landing of one or more floating plants is carried out on a pier in a shallow seabed roadstead or a sea area suitable for a hull cleaning and washing treatment for ships, and wherein an electric supply for charging batteries originates from onshore or offshore electric power generation plants.

11. The floating plant according to claim 1, wherein the members for engaging and positioning comprise lateral pushers, protruding towards a center of the basin with arms provided with rollers in contact with the side walls of the ship engaged during the treatment.

12. The floating plant according to claim 1, wherein the guiding means for engaging the ship comprises lateral supports at the level of water for guiding a framework, which are aligned so as to converge with a longitudinal axis of the plant.

13. The floating plant according to claim 1, wherein operations for displacing the plant and its constant control, engaging and disengaging the hull of the ship with approach and alignment maneuver with continuous control of a centering of the hull, cleaning treatment operation of the hull with continuous command and control of the cleaning and washing means including an adjustment of a position of the means themselves in a treatment basin between the side walls and on the floor of the dock, and storing the cleaning and washing service data of the hull in a control of a plant movement and plant internal parts, are carried out by a command and control process of the floating and maneuverable plant, for each hull of a ship treated to form a database so as to allow, in carrying out repeated cleaning and washing services over time, a semi-automatic, or an automatic treatment operation.

14. The floating plant according to claim 1, wherein the propulsion members for the maneuver of the floating plant are positioned on most extended parts of the floor of the dock.

15. The floating plant according to claim 1, wherein the propulsion members for the maneuver of the floating plant are positioned at the bow and at the stern.

16. The floating plant according to claim 1, wherein, at ends of the side walls, flexible and inflatable bulkheads are disposed in an upper edge.

17. The floating plant according to claim 1, wherein, at ends of the side walls, an inflatable upper edge, equipped with rollers for sliding the flexible and inflatable bulkhead when placed in contact with the hull of the treated ship, is disposed.

18. The floating plant according to claim 1, wherein the cleaning and washing means includes rotating brushes having a horizontal axis which is longitudinal to an axis of the floating plant.

19. The floating plant according to claim 1, wherein the cleaning and washing means includes multiple belts with pressurized water jets oriented towards a surface of the hull being treated.

20. The floating plant according to claim 1, wherein the guiding means for engaging the ship comprises lateral supports at the level of water for guiding a framework.

* * * * *